US006655093B1

(12) United States Patent
Gavin

(10) Patent No.: US 6,655,093 B1
(45) Date of Patent: Dec. 2, 2003

(54) RISER SECTION AND COVER THEREFOR

(76) Inventor: Norman W. Gavin, 173 Church St., Wallingford, CT (US) 06492

( * ) Notice: Subject to any disclaimer, the term of this patent is extended or adjusted under 35 U.S.C. 154(b) by 50 days.

(21) Appl. No.: 09/946,293

(22) Filed: Sep. 4, 2001

Related U.S. Application Data

(63) Continuation-in-part of application No. 09/766,795, filed on Jan. 22, 2001, now Pat. No. 6,484,451.

(51) Int. Cl.[7] ..... E02D 29/12

(52) U.S. Cl. ..... 52/20; 52/19; 52/592.6; 220/4.26

(58) Field of Search ..... 52/19, 20, 137, 52/141, 169.6, 592.5, 592.6; 206/505, 509, 515; 404/25; 220/4.26; D25/36

(56) References Cited

U.S. PATENT DOCUMENTS

| | | | | | |
|---|---|---|---|---|---|
| 537,182 | A | | 4/1895 | Brown | |
| 871,977 | A | | 11/1907 | Winslow | |
| 2,545,577 | A | * | 3/1951 | Griffin | 220/4.03 |
| 3,385,012 | A | | 5/1968 | Lovegreen | |
| 3,772,826 | A | | 11/1973 | Ferver | |
| 3,920,347 | A | * | 11/1975 | Sauriol et al. | 404/25 |
| 4,123,184 | A | * | 10/1978 | Whitlock | 404/25 |
| 4,197,031 | A | * | 4/1980 | Hild | 404/26 |
| 4,410,099 | A | * | 10/1983 | deLarosiere | 220/516 |
| 4,508,470 | A | * | 4/1985 | Ferns | 404/25 |
| 4,593,714 | A | * | 6/1986 | Madden | 137/371 |
| 4,659,251 | A | * | 4/1987 | Petter et al. | 405/52 |
| 4,842,443 | A | * | 6/1989 | Argandona | 405/52 |
| 4,852,757 | A | | 8/1989 | Gold | |
| 5,038,540 | A | | 8/1991 | Krautz | |
| 5,076,456 | A | * | 12/1991 | Geyer | 220/4.26 |
| 5,114,271 | A | * | 5/1992 | Sunderhaus et al. | 405/52 |
| 5,123,776 | A | * | 6/1992 | Lang et al. | 404/25 |
| 5,366,317 | A | * | 11/1994 | Solimar | 404/25 |
| 5,386,669 | A | | 2/1995 | Almeida | |
| 5,513,926 | A | | 5/1996 | Prescott | |
| 5,542,780 | A | | 8/1996 | Kourgli | |
| 5,582,297 | A | * | 12/1996 | Carter | 206/521.1 |
| 5,617,679 | A | | 4/1997 | Meyers | |
| 5,653,559 | A | | 8/1997 | Stieb et al. | |
| 5,660,279 | A | * | 8/1997 | Apps et al. | 206/503 |
| 5,852,901 | A | | 12/1998 | Meyers | |
| 6,088,972 | A | | 7/2000 | Johanneck | |
| 6,195,944 | B1 | | 3/2001 | Goldthorpe | |

FOREIGN PATENT DOCUMENTS

| | | |
|---|---|---|
| GB | 2185053 | 7/1987 |

* cited by examiner

*Primary Examiner*—Brian E. Glessner
(74) *Attorney, Agent, or Firm*—Jenner & Block, LLC

(57) ABSTRACT

A riser section and cover is disclosed. The riser section has a smooth cylindrical sidewall surface, a tapered end and a channel end, a removable anchor tab and bosses and ribs on the inside of the sidewall. The riser sections are stackable. The cover has a channel end to removably connect to a riser section. The cover has stowable handles and posts extending from a bottom surface that define wells open at a top surface which fit into the wells of another cover. A bracket is disclosed to releasably secure and position a cover with attached riser section on a concrete form wall.

53 Claims, 8 Drawing Sheets

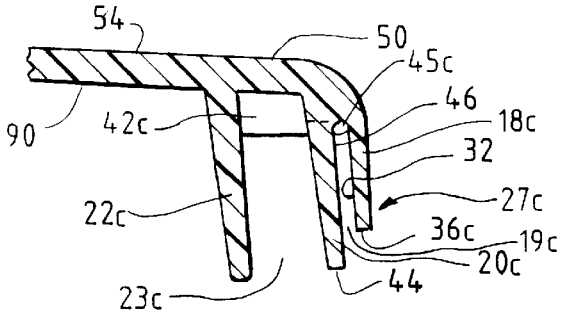
FIG. 2A
FIG. 2
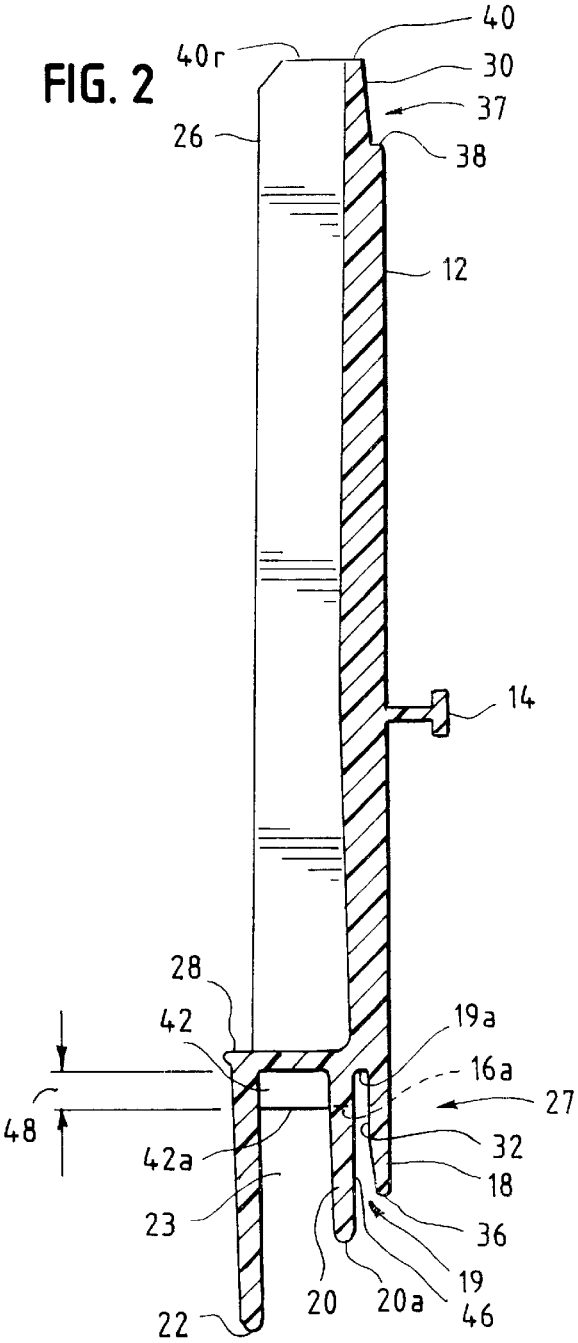
FIG. 2B
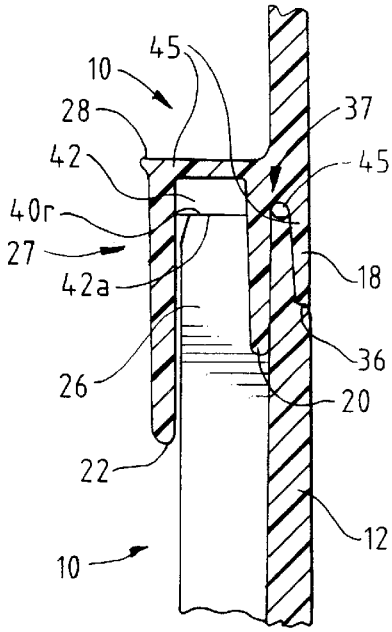

RISER SECTION AND COVER THEREFOR

CROSS REFERENCE TO RELATED APPLICATIONS

This application is a continuation-in-part of U.S. patent application Ser. No. 09/766,795, filed Jan. 22, 2001 now U.S. Pat. No. 6,488,431.

BACKGROUND OF THE INVENTION

1. Field of the Invention

The present invention pertains to stackable riser sections and riser covers for access risers. More particularly, the present invention pertains to connecting a series of riser sections in a way that provides improved vertical support that minimizes the effect of frost heaving and other forces due to vertical ground movement, and resists rotational forces resulting from lateral ground movement and to a removable riser cover for stackable riser sections. It further relates to the configuration of a riser cover that provides a fluid and gas tight seal to a riser section, and to structure to facilitate its removal from a riser section as well as facilitating locating the cover under ground and to the stacking of a plurality of riser covers for compact and stable shipment or storage. It also relates to a system and method of maintaining the position and shape of a riser section while the riser section is being anchored in concrete by using the riser cover for positioning and support during the anchoring process.

2. Discussion

Meters, splices, junction boxes, and other components of buried utility systems are often located inside hand-holes or manholes to enable easy access by utility workers from above ground. Often, utility systems provide such access facilities at key points, such as a major bend in an underground cable/conduit run or location of water or gas meters and other equipment requiring servicing or inspection. Such access facilities have been constructed using pre-formed or poured concrete side retaining walls. Concrete can be expensive, particularly where the application requires a non-standard size or length, in which case setting forms and pouring concrete adds time and expense. Also, over time, the concrete can crack due to forces caused, for example, by freezing and thawing or by heavy vehicles being driven over the top of the manhole. Tiled sidewalls and concrete block are examples of other labor intensive alternatives.

Injection molded, plastic, stackable riser sections made of high density polyethylene and other rigid, light weight polymeric material are known in the art and provide a less expensive, standardized alternative that lends itself to rapid on-site customization. Riser sections can be manufactured in various heights and diameters, and a series of identically sized riser sections can be stacked to achieve a desired depth.

Depending on the soil characteristics and overhead traffic, the vertical, horizontal, and rotational forces placed upon these riser sections can be considerable. A major shortcoming of plastic riser sections lies in their tendency to deform or break when subjected to such forces. The use of vertical and horizontal strengthening ribs to alleviate this tendency is common. When placed along the exterior of the sidewall, however, these reinforcing ribs themselves often are subjected to the same vertical and horizontal forces they are intended to protect against.

U.S. Pat. No. 5,852,901 for a "Stackable Riser for On-Site Waste and Drainage Systems," issued to Meyers, illustrates one prior art design of a plastic riser section for forming a depth-adjustable, grade-level access for underground components. The Meyers riser sections form a rigid structure intended to support heavy loads applied to the grade level access lid. Identical riser sections reinforced along portions of both the inner and outer walls are stacked one on top of the other utilizing a single tongue and groove connection. A horizontal rib extending outward along the circumference of the external surface of the side wall of each cylindrical riser section and a plurality of vertical ribs, also on the external surface of the riser, individually anchor each riser section in the ground. A plurality of riser sections can be stacked to form a vertical, air-tight, liquid-tight, and gas-tight riser stack and cover system.

The shifting of the ground surrounding the riser stack disclosed in the Meyers patent can twist and move the stacked riser sections, knocking them out of alignment. Eventually, the shifting can lead to rupture of the stacked riser sections' sidewall. The presence of external horizontal and vertical reinforcing ribs extending along the wall of each riser, while strengthening the riser section sidewalls, also exacerbates this problem because shifting soil applies force against each exposed rib. The configuration of the tongue and groove arrangement of the riser sections disclosed in the Meyers patent also precludes the placement of supporting ribs along the full vertical length of the interior riser section wall, which lessens the sidewall's resistance to forces exerted by the shifting of the soil abutting the sidewalls and external ribs.

It is also common for one section of a riser stack to be anchored in concrete. The anchored section, generally the section defining the opening into the chamber defined by the concrete walls of an underground component, is then used as a base for the riser. Other sections are stacked on top of the anchored section to the desired height of the riser. This process involves positioning and securing a hollow riser section inside a concrete mold or form of a shape for forming the top wall of a chamber or underground component. The concrete is then poured into the mold around the riser section. The riser section can be subjected to stress during this process and may deform or break under these conditions. In addition, because it can be made of light weight plastic, it can be difficult to keep the riser section in place while pouring the concrete because the riser section may tend to float in the concrete.

One method of preventing deformities in the riser section during anchoring involves the addition of cross braces to the inside of the riser. The braces can conform to the shape of the riser section or can simply be metal or wood rods sufficiently long to provide lateral support for opposed riser section sidewalls. This solution is imperfect, however, because the sidewall support thus provided is not uniform and may still permit deformities to occur. Additionally, this solution adds to the cost and time needed to anchor a riser section in concrete.

A variety of methods have been employed to keep a riser section in place during the anchoring process, with almost all involving construction on an ad-hoc basis in the field. One method is to place one or more elastic straps or rubber cords across the top of the concrete form, ensuring contact with the riser section in order to hold it down. This does not address side-to-side movement. One way to attempt to control this is by placing a weight or heavy object, such as a concrete block, on top of the riser section and under the elastic strap. The weight, however, may create an additional problem because it adds to the stresses being applied to the riser section sidewalls during placement of the concrete.

Another difficulty with the use of plastic riser sections is locating the riser stack after installation. Many riser access facilities are located in areas where it is easy to locate the opening, such as in streets, sidewalks, and other paved areas, or where the opening is above grade. However, access facilities frequently are located below grade level and are covered by soil and grass or other vegetation. In these situations, it may be difficult to locate the opening of the access facility when required. While a metal cover may be located using a metal detector, plastic stackable riser sections may not. One method of making plastic riser stacks locatable is to mold one or more metal rods into the concrete wall into which a plastic riser section has been anchored. Because the concrete wall is typically lower in the ground than the riser cover, a significant amount of metal is required in order to ensure it can be detected at the surface using a conventional metal detector. This method may also create an added step in casting the wall of the box into which the bottom riser section is anchored.

SUMMARY OF THE INVENTION

The riser sections and cover of the present invention overcome the foregoing shortcomings. In the preferred embodiment, the stackable riser sections of the present invention have a hollow, cylindrical configuration, although configurations other than cylindrical may be used. The sidewall of the riser section includes a channel end and a tapered end. In the preferred embodiment, the riser section has a nearly smooth exterior surface from which projects outwardly a detachable anchor tab that may run along substantially the full circumference of the riser. The channel end of the riser section sidewall includes two adjoining channels which are defined by interior, middle, and exterior walls that extend down from a horizontal ledge on the interior surface of the side wall at the channel end. The walls project concentrically with, or (in the case of riser sections having, for example, a square or rectangular cross-section) parallel to, the sidewall. The opposite, or tapered, end of the riser section sidewall terminates in a portion tapered to a narrower thickness at the end. A plurality of vertical reinforcing ribs are spaced around the interior surface of the cylindrical sidewall of the riser. Because in the preferred embodiment the ribs extend from the horizontal ledge at or near the channel end to the distal end of the tapered end of the riser section sidewall, they strengthen the sidewall in the area of the joint between each pair of stacked riser sections.

In the preferred embodiment, the interior surface of the sidewall also includes at least one, and preferably more than one, boss extending vertically from the horizontal ledge near the channel end to the distal end of the tapered end of the riser. Each boss is adapted to receive a screw, or other fastener, that extends through the horizontal ledge of a riser section stacked above the tapered end for securing that riser section stacked on top of the first riser section. The bosses also may receive a screw to attach a cover at the top of a riser stack.

The tapered end of the riser section sidewall is configured to mate with the two concentric channels of either another riser section or a cover. The radially outer channel is shallower than the inner channel in the preferred embodiment and accepts the tapered end of the sidewall of another riser section on which it is placed. An O-ring placed in the outer channel can be used to effect a water-tight and gas-tight seal between two stacked riser sections (or between a riser section and a cover).

The radially inner channel is wider than the outer channel, and accepts the interior vertical support ribs and bosses of a riser section on which it rests. The middle wall of the channel end includes slots that permit positioning of the bosses and ribs within the inner channel of a riser section positioned above the ribs and bosses. Projections on the bottom of the horizontal ledge and aligned with the slots support the upper riser section on the bosses as ribs of the lower riser section.

In the preferred embodiment, a detachable anchor tab on the exterior surface of the riser section sidewall serves to anchor the lower-most riser section in concrete, for example, in the wall of a concrete distribution box. The concrete is poured around the riser section and its anchor tab, thereby anchoring the bottom riser section after the concrete hardens. Another identical riser section may be placed on top of the bottom riser section, with the tapered end of the bottom riser section mating with the channel end of the riser section placed on top of the bottom riser section. The anchor tab on each of the riser sections stacked above the bottom riser section (i.e., above the riser section anchored in the concrete box) in a given stack can be detached by tearing it away from the exterior of the sidewall. In the preferred embodiment, the anchor tab includes a handle for this purpose. Tearing away the anchor tabs on the riser sections that are not anchored in concrete gives the riser stack a nearly smooth exterior surface, thereby minimizing the forces exerted on the riser stack by movement of the soil in contact with the riser stack.

There also is provided, in the preferred embodiment, a cover adapted to be secured to the top of a riser section. Like the stackable riser, the preferred shape is cylindrical, but other configurations, such as square, rectangular or elliptical may be used.

The cover has a top surface and a bottom surface, with the top surface being nearly smooth and slightly convex in the preferred embodiment. A sidewall of the cover depends from the top surface. It includes a channel end similar to the channel end of the riser sections. The channel end includes two adjacent concentric channels defined by inner middle and outer walls. The outer wall defines the sidewall outer surface of the cover.

Handles to aid in removal of the cover are provided on the top surface of the cover. In the preferred embodiment, each handle pivots about a support shaft which is attached to the cover by a screw or other fastener. The support shaft is set inside a recess adjacent the top surface, and the handle pivots between a position generally perpendicular to the top surface and a position inside the recess, substantially parallel to and flush with the top surface. The recess is large enough to accept the entire handle.

The cover preferably has at least two wells open to the top surface. They may be substantially 180° apart in the preferred embodiment, although another embodiment may have only one well or more than two wells. The wells are defined by hollow posts depending from the bottom surface of the cover.

In a preferred embodiment, the hollow posts on the bottom surface extend to below the bottom edge of the channel end of the cover. The posts define the wells open at the top surface, as described above. Preferably, the posts are located approximately midway between the center of the bottom surface and the cover channel, about 180° apart from each other. In different embodiments, there may be only one post or more than two posts, in which case the posts may be located as desired on the bottom surface.

The posts extending from the bottom surface of the riser cover preferably are tapered such that each is of a larger diameter where it joins the bottom surface of the cover than at its free end. There may also be a stepped change in diameter at some point between the bottom surface and the end of the post, creating a shoulder. The diameter of the free end of each post is smaller than the diameter of the hollow well formed by the post. The tapered design of each post and well allows stacking of multiple riser covers by placing the posts of one riser cover into corresponding wells in the top of another riser cover. Stacking of riser covers is beneficial for storage and for shipping multiple riser covers.

The wells open to the top of the riser cover may receive a metal bar prior to completion of the underground component such as a concrete distribution box installation in the field. As described above, it is common for riser covers to be buried by soil and vegetation growth. The placement of the metal bar into the well allows the cover and plastic riser sections to be located using a metal detector.

The riser cover can be used in a method to secure a riser section while the riser section is being molded in concrete (i.e., while the wet, viscous concrete is poured and is setting). In the preferred method of securing a riser section in concrete, a mounting bracket is provided which is adapted to receive the posts depending from the bottom surface of a cover. The mounting bracket adapted to be secured to the wall of a concrete form preferably has two (or other number corresponding to the number of posts in the cover) holes configured to accept and releasably retain the posts of the riser cover. The holes are sized and tapered such that when the posts are pushed into the holes, the sides of the holes grip the posts in a friction fit and thereby firmly secure the cover to the bracket.

During the concrete casting operation, the mounting bracket is secured to a horizontal wall of a concrete form at a desired location where the access riser is to be provided. The riser section is positioned on the form surrounding the bracket. A riser cover, positioned with the channel end of the cover engaged with the tapered end of the riser section is attached to the bracket. The posts of the cover are aligned with, and pushed into, the holes on the mounting bracket such that the posts are gripped securely by the bracket. The riser section is thus positioned and secured properly relative to the bracket and, particularly, the concrete form. The riser section is also supported against deformation during a pour. Concrete sufficient to secure the riser section is then poured into the form and allowed to cure. The riser cover, which has not been in contact with the concrete, is then removed from the riser section by pulling the posts out of the holes in the mounting bracket. The mounting bracket may then be removed and the form disassembled from the poured concrete wall.

It is an object of the present invention to provide an improved connection configuration that resists rotational forces exerted on one or more riser sections in an interconnected system.

It is another object of the present invention to provide improved reinforcement of the sidewalls of riser sections stacked one on top of the other.

It is still another object of the present invention to provide a detachable anchor on the exterior surface of a riser section, the anchor being used when the riser section is to be molded in concrete, and removed when the riser section is to be in contact with soil.

It is a further object of the present invention to provide a riser section adapted for being anchored in concrete, while at the same time minimizing the susceptibility of a riser stack to forces caused by the ground next to the stack shifting.

It is a further object of the present invention to provide a riser cover having recessed handles such that the riser cover will have an essentially smooth top exterior surface when the handles are not in use.

It is still a further object of the present invention to provide a method for positioning and supporting a riser section being molded in concrete to minimize the susceptibility of movement of the riser section during the molding process and resist deformation of the riser section due to the forces exerted by the concrete while being poured.

It is still a further object of the present invention to provide a riser cover adapted for being stacked one on top of another with the posts of the top cover projecting into the wells of the bottom cover such that multiple covers may be stacked compactly and stably for shipping or storage.

It is another object of the present invention to provide a plastic riser cover adapted to easily receive a metal bar in order to permit the cover to be located after it has been buried in soil or other material.

Other features, objects and advantages of the invention will become apparent from the following description and drawings in which the details of the invention are fully and completely disclosed as part of this specification.

BRIEF DESCRIPTION OF THE DRAWINGS

The features of the present invention are explained in more detail with reference to the illustrative embodiments shown in the following drawings.

FIG. 2 is a cross-sectional view of the riser section embodying the principles of the present invention taken along line 2—2 in FIG. 1;

FIG. 2A is a fragmentary cross-sectional view of a riser cover for overlying a riser section embodying the principles of the present invention;

FIG. 2B is a fragmentary cross-sectional view of a pair of riser sections assembled together.

DETAILED DESCRIPTION OF PREFERRED EMBODIMENTS

Figure 1:
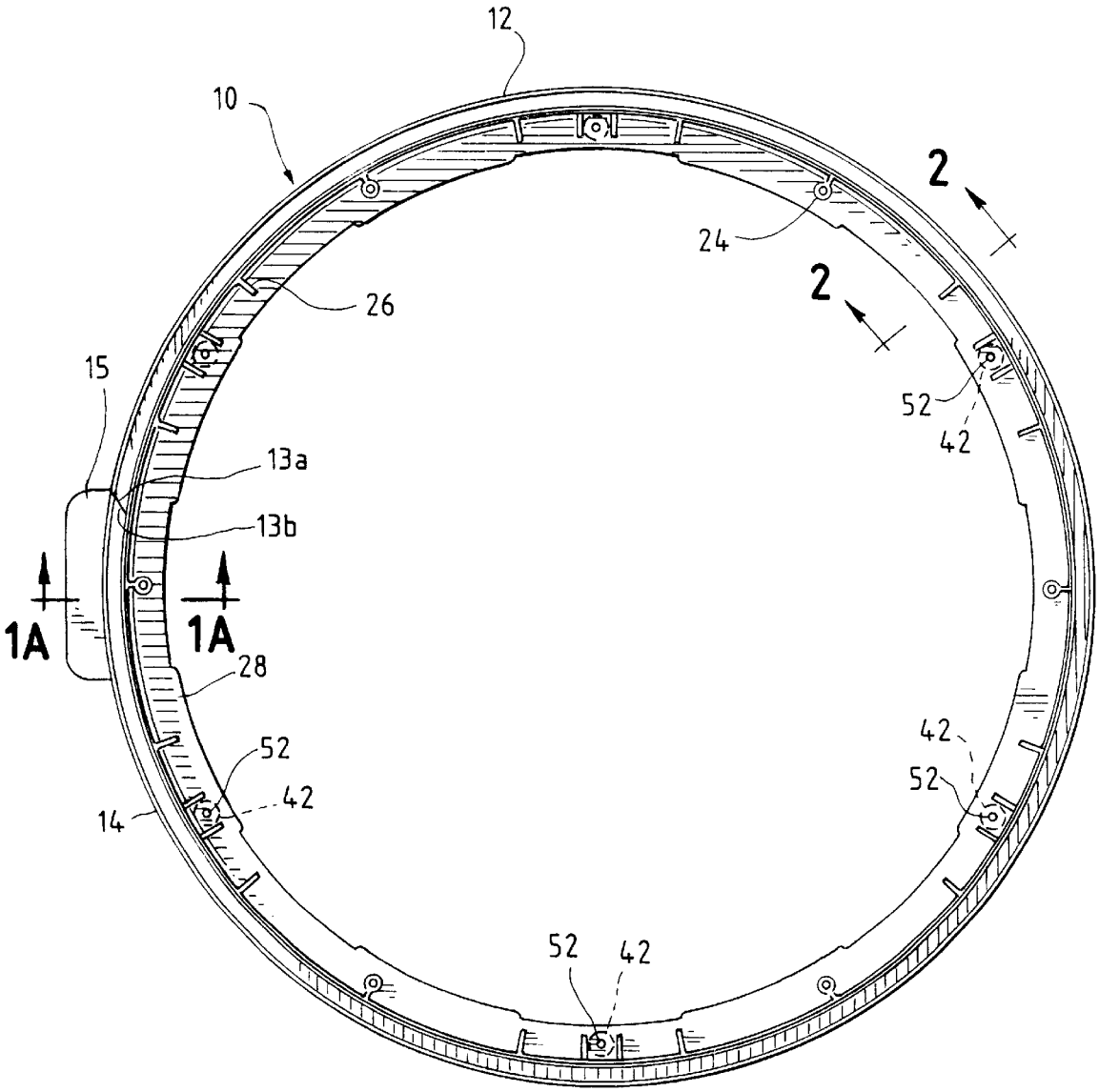
FIG. 1 is a top view of a cylindrical riser section embodying the principles of the present invention.
Figure 1A:
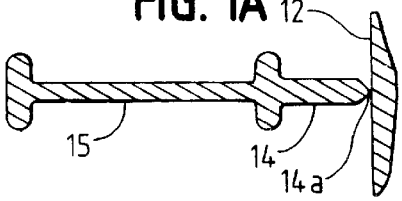
FIG. 1A is a fragmentary sectional view on an enlarged scale, taken along the line 1A—1A of FIG. 1.

Terms such as upper and lower, top and bottom, above and below, as used to describe the illustrated embodiments have their ordinary and usual meanings and are applied to riser sections and covers as they would normally be oriented in association with an underground component such as a concrete distribution box. The riser sections and covers illustrated are generally concentric about an imaginary vertical centerline. Terms such as inner, internal or interior, mean toward the centerline, and outer, external or exterior mean away from the centerline.

Referring to FIGS. 1–4, in the preferred embodiment of the present invention a riser section 10 includes generally cylindrical sidewall 12 having a plurality of vertical bosses 24 and a plurality of vertical reinforcing ribs 26 on the interior surface of sidewall 12. The exterior surface of sidewall 12 is devoid of vertical reinforcement elements.

Attached to the substantially smooth exterior surface of sidewall 12 is detachable anchor tab 14 (discussed below). Sidewall 12 has a top, tapered end 37, and a bottom, channel end 27. (In an alternative embodiment, end 37 could be straight rather than tapered.) Alternatively, the tapered ends 37 could be on the bottom and the channel ends could be on the top in a stack of riser sections 10 of the present invention.

Figure 4:
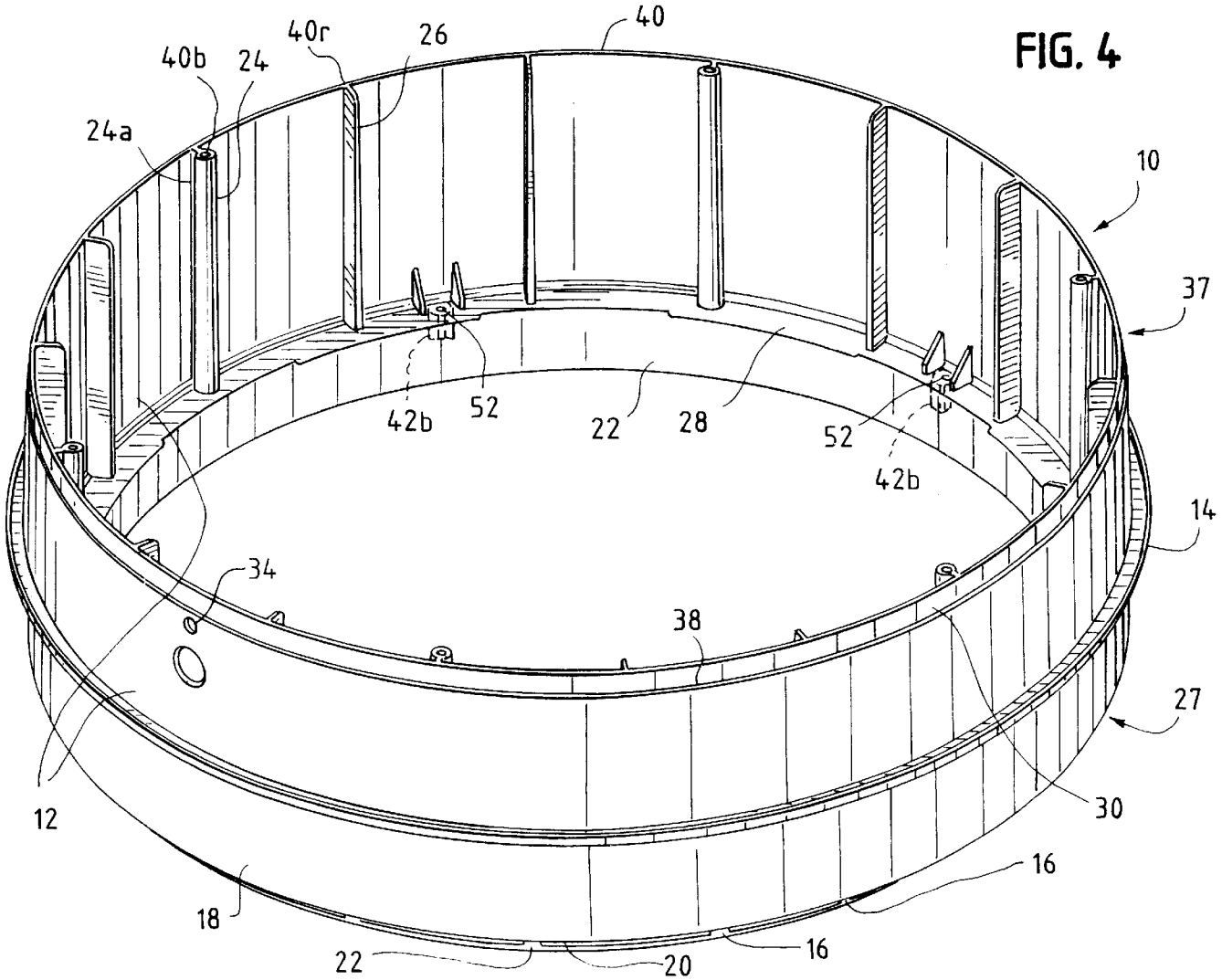
FIG. 4 is perspective view of a cylindrical riser section embodying the principles of the present invention.

In the preferred embodiment, tapered end 37 includes on the external surface of sidewall 12 a horizontal edge surface 38 (i.e., edge surface 38 is substantially perpendicular to the axis of the vertical riser section and the external face of sidewall 12). With reference to FIG. 4, edge surface 38 extends around the circumference of sidewall 12. End 37 includes a tapered portion 30 extending from horizontal edge surface 38 to the distal end of tapered end 37 of sidewall 12 of riser section 10. Tapered end 37 thereby forms a unique male connector. The opposite end of riser section 10 forms a corresponding female connector, referred to herein as channel end 27, as described below.

Figure 3:
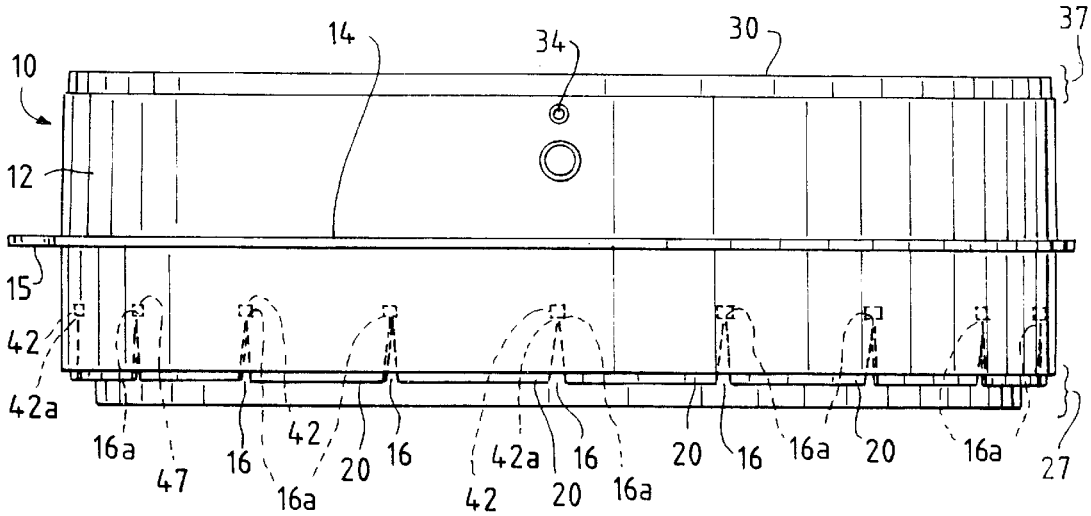
FIG. 3 is a side view of a cylindrical riser section embodying the principles of the present invention.

Referring to FIGS. 2, 3 and 4, the channel end 27 of riser section 10 comprises a unique dual channel arrangement in which outer wall 18, middle wall 20, and inner wall 22 extend relative to an internal horizontal ledge 28, and generally parallel to the exterior surface of sidewall 12 to define outer channel 19 and inner channel 23.

Horizontal ledge 28 on the interior surface of sidewall 12 (see FIGS. 1, 2, 3A and 4) is generally perpendicular to sidewall 12. As shown in FIGS. 2 and 4, bosses 24 and ribs 26 extend vertically from ledge 28 to the distal end 40 of tapered end 37. Bosses 24 are attached to or formed on the interior surface of sidewall 12 by an offsetting portion 24*a* (see FIG. 4) that extends from the inside surface of sidewall 12 to the boss 24, connecting member or offsetting portions 24*a*, which preferably runs along the full vertical height of each boss 26. End 37 of riser section 10 includes the ends 40*b* and 40*r* of vertical bosses 24 and ribs 26, respectively, the ends 40*b*, 40*r* being flush with the horizontal edge 40 on the end of tapered portion 30 of sidewall 12. The top surfaces 40*b* of offsetting portions 24*a* and bosses 24 and top surfaces 40*r* of ribs 26 are flush with the top surface 40 of tapered end 37.

Referring to FIG. 2B, when the tapered end 37 of one riser section 10 and channel end 27 of another riser section 10 are mated, top edge 40 of tapered portion 30 is positioned within outer channel 19, which is the channel or space between inner surface 32 of outer wall 18 and outer surface 46 of middle wall 20. Bottom edge 36 of outer wall 18 thus rests upon edge 38 on the exterior surface of sidewall 12.

As seen in FIG. 2B, when one riser section is placed on top of another, top edge 40 of the riser section on the bottom projects into outer channel 19 of the upper riser section. In the preferred embodiment, an O-ring 45 or similar resilient gasket is positioned at the bottom 19*a* of outer channel 19 such that when the first riser section is placed on top of a second riser section top edge 40 of tapered end 37 abuts against the O-ring 45 to provide a substantially water-tight and gas-tight seal.

Sealant can be applied to the area where the tapered end 37 of a first riser section 10 contacts the outer channel 23 of another riser section 12 (or a cover 50) stacked on top of the first riser section 10 to further ensure a water-tight, gas-tight seal between adjacent riser sections 10 (or between a riser section 10 and a cover 50 ) beyond that provided by the dual channel design of the present invention.

Figure 3A:
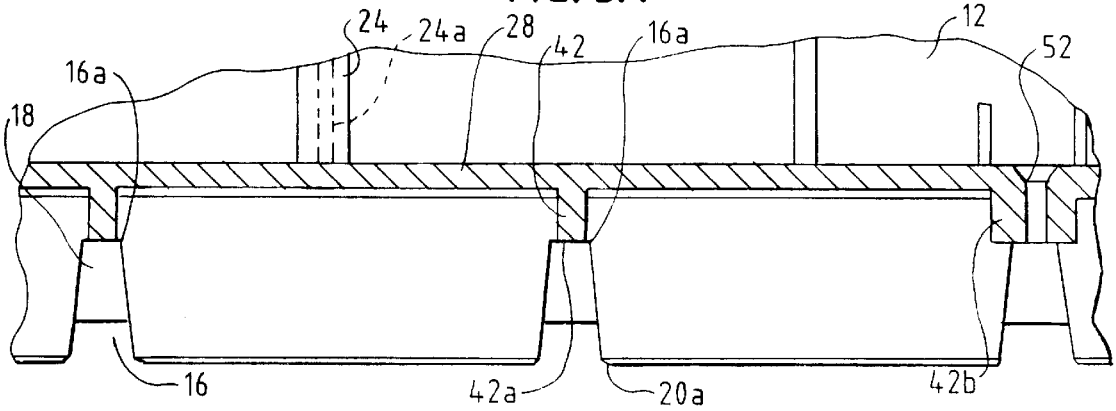
FIG. 3A is a fragmentary sectional view on an enlarged scale of a portion of the riser section of FIG. 3.

As shown in FIGS. 2–4, and in particular FIG. 3A, channel end 27 of the present invention includes middle wall 20 having slots 16 at regular intervals. The slots 16 are spaced in middle wall 20 of a first riser section 10 such that they align with offsetting portions 24*a* of bosses 24 and with ribs 26 of an end 37 of a second riser section 10 when the first riser section is placed on top of the second riser section. Bosses 24 and ribs 26 of the second riser section 10 thereby extend into inner channel 23 of the first riser section 10.

With reference to FIGS. 2, 3 and 3A, each slot 16 extends from end 20*a* of wall 20 to top 16*a*. The top 16*a* of each slot 16 is flush with the end 42*a* of a vertical projection 42 in inner channel 23. Each projection 42 (shown partially by the phantom lines in FIG. 3 and shown in FIG. 3A) projects into outer channel 23 a height indicated by line 48 (see FIG. 2). Offsetting portions 24*a* of bosses 24 and supporting ribs 26 of a first riser section are adapted to slide into slots 16 in a second riser section when the second riser section is placed on top of the first riser section. In a preferred embodiment, slots 16 and corresponding projections 42 are spaced midway between bosses 24 and ribs 26 which increase the structural integrity of the riser section 10.

The vertical bosses 24 each contain on their end 40*b* a hollow bore adapted to accept a screw, or other suitable fastener. Projections 42*b* are provided in riser section 10 that align with a boss 24 of another riser section 10 when stacked. Projections 42*b* are somewhat wider than projections 42 not aligned with a boss 24. Such bosses contain a hollow bore best shown in FIGS. 1 and 3A so that a screw or other suitable fastener (not shown) can be inserted through projection 42*b* in the first riser section 10 into the top end of a boss 24 below it in a second riser section 10 to fasten the two riser sections together. In that case, ledge 28 contains an opening 52 over the projections 42*b* having the hollow bores so that a screw or other fastener may be inserted through projection 42*b* and into the top end 40*b* of boss 24 below it when two riser sections 10 are stacked.

As shown in FIGS. 2B, 3A and 4, when two riser sections 10 are placed one on top of the other, slot 16 can accept either, referring now to FIG. 2, top edge 40*r* of a rib 26 or top edge 40*b* of offsetting portion 24*a* of a boss 24. In one embodiment, a riser section is rotated 15° with respect to a riser section above or below it in a stack. As best seen in FIGS. 1 and 4, bosses 24 are spaced at 60° intervals about the interior surface of sidewall 12. Two ribs 26 are equally spaced between each pair of successive bosses. Thus, there is a boss 24 or a rib 26 located every 20° about the interior surface of the sidewall 16. Slots 16 and corresponding projections 42 are spaced midway between adjacent bosses 24 and ribs 26. Such slots and projections are, therefore, disposed every 20° about the horizontal ledge 28 but displaced 10° from the bosses 24 and ribs 26.

Referring to FIGS. 1, 2, 2B and 4, channel end 27 of an upper riser section 10 receives the tapered end 37 of another riser section 10 disposed below it with bosses 24 and ribs 26 disposed in slots 16. Bosses 24 of lower riser section 10 are aligned with, and support, projections 42*b* of the upper riser section 10. Ribs 26 are aligned with, and support, the upper riser projections 42. The two sections are secured together with screws that extend through openings 52 and hollow bores in projections 42*b* into hollow bores in bosses 24. Additional riser sections 10 can be stacked above or below the first and second riser sections, as desired. In each case, the upper riser section is rotated 30° relative to the lower riser section to permit positioning of the offsetting portions 24*a* of the bosses 24 and ribs 26 of the lower riser section within slots 16 of the upper riser section.

The relatively narrow width of slots 16 in middle wall 20, as shown in FIGS. 3, 3A and 4, substantially limits any rotation of riser section 10 with respect to another riser section 10 stacked above or below the first riser section because the offsetting portions 24*a* of bosses 24 and the ribs 26 pass through and are restricted against angular lateral movement by the sides of slots 16.

As best seen in FIG. 2B, the height of projections 42 and 42*b* is such that the edges 42*a* of projections 42 or 42*b* abut against edges 40*b* and 40*r* of bosses 24 and ribs 26, respectively, of the second riser. Accordingly, sidewalls 12 are reinforced along the full height of sidewall 12 by the combined height of projections 42 and 42*b* and either bosses 24 or ribs 26. Outer wall 18 and middle wall 22 prevent horizontal movement of two stacked riser sections 10 with respect to each other.

Referring to FIGS. 1, 1A, 2 and 3, detachable anchor tab 14 runs along the outside surface of the sidewall 12. The bottom-most riser section 10 within a vertical stack may be anchored in concrete (e.g., a concrete distribution box not shown), in which case anchor tab 14 serves to anchor the bottom-most riser section 10 within the concrete. In the preferred embodiment, pull handle 15 is attached near ends 13*a*, 13*b* of anchor tab 14. Anchor tab 14 is severed or has a weakened cross-section at ends 13*a*, 13*b* such that pulling on handle 15 in a radial direction separates ends 13*a* and 13*b*. Preferably, anchor tab 14 is attached to the outside of sidewall 12 by a weakened region 14*a*, such that continuing to pull handle 15 away from the sidewall 12 causes anchor tab 14 to tear away form the outside surface of riser section 10 in region 14*a*.

Anchor tab 14 is preferably completely removed from riser section 10 when riser section 10 is not intended to be anchored in concrete. Detaching anchor tab 14 from each of the riser sections placed above the bottom-most riser section (i.e., all of the riser sections except the bottom one that is anchored in concrete) enhances the stability of the entire stack by providing a substantially smooth external surface that is less susceptible to forces caused by ground heaving and shifting than if the external surface contained the anchor tabs 14 (or any other projecting elements, such as support ribs). In this way, the alignment and integrity of the overall riser stack is maintained in areas subject to soil movement caused by freezing and thawing or heavy traffic over the top of the riser.

A riser cover 50 (see FIG. 2A) can cover the uppermost riser section 10 in a stack of riser sections 10. Preferably, the cover is made from the same material as the associated riser sections, namely, molded high density plastic, such as polyethylene.

The cover 50 may include a similar configuration as the channel end of riser sections 10 and may include projections 42*c* having hollow bores for accepting screws or other fasteners as described above for fastening two riser sections 10 together. In an alternate configuration, the cover 50 will have an end with the same configuration as tapered end 37 of riser sections 10 and the top of the associated riser section will define a channel end such as end 27.

Figure 5:
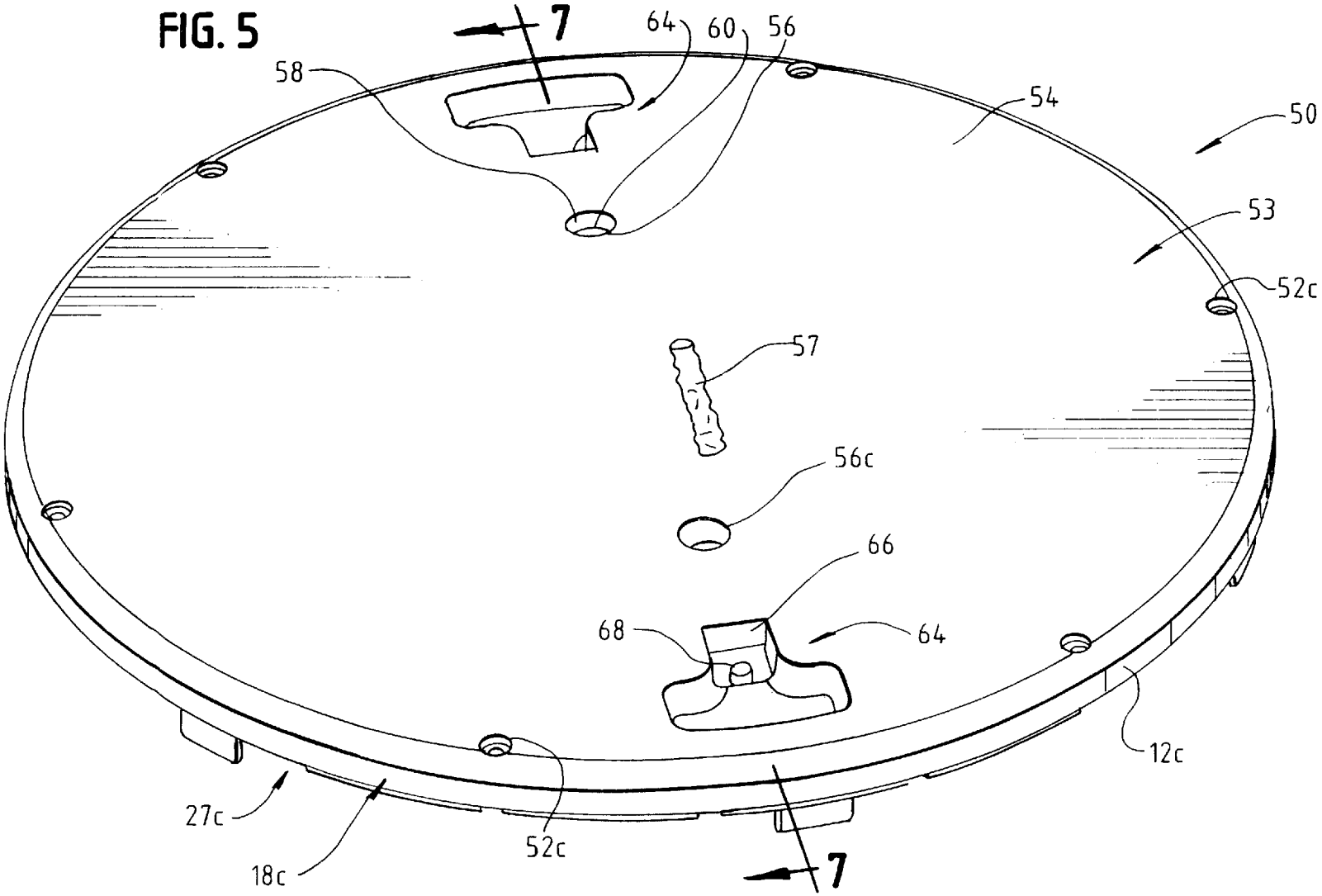
FIG. 5 is a perspective view of the top surface of a riser cover embodying the principles of the present invention.
Figure 6:
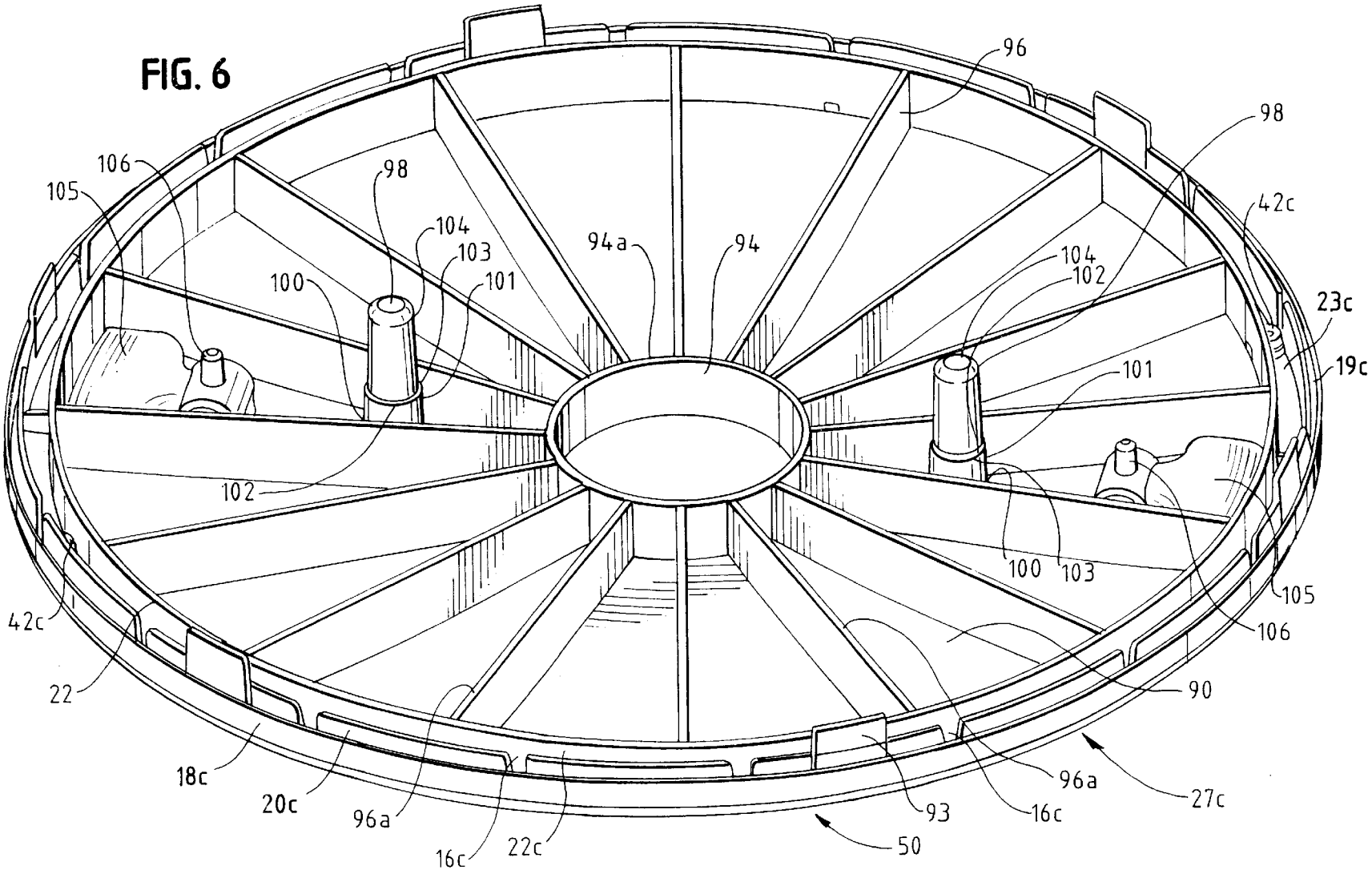
FIG. 6 is a perspective view of the bottom surface of a riser cover embodying the principles of the present invention.
Figure 7:
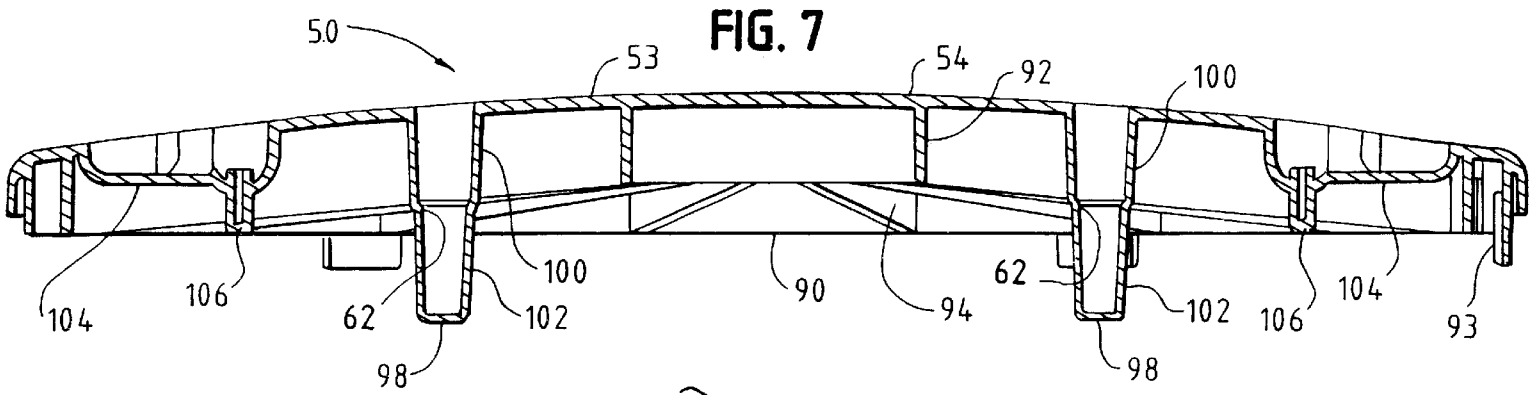
FIG. 7 is a cross-sectional view of the riser cover embodying the principles of the present invention taken along line 7—7 of FIG. 5.

Referring now to FIGS. 5–7, there is shown a riser cover 50 of the present invention for removably closing the access to an underground component through a riser formed by stacked riser sections 10. Riser cover 50 is shown as circular in the preferred embodiment but can be of another shape that corresponds to the shape of the riser section to be covered.

Riser cover 50 includes a wall 53 defining a top convex surface 54, a bottom concave surface 90. A channel end 27*c* similar to channel end 27 of riser section 10 depends from wall 53. It includes an outer wall 18*c* that defines the smooth outer peripheral surface of the cover. Channel end 27*c* includes a middle wall 20*c* spaced inward of outer wall 18*c* that includes spaced slots 16*c* shaped and spaced as the slots 16 in middle wall 20 of a riser section 10. It defines with outer wall 18*c*, outer channel 19*c*. Channel end 27*c* includes inner wall 22*c* similar to middle wall 22 of channel end 27 of a riser section 10. It defines with middle wall 20*c*, inner channel 23*c*.

Projections 42*c*, best seen in FIG. 6, are located within inner channel 23*c* on riser cover 50 and contain a hollow bore defining openings 52*c* at top surface 54. These bores receive a screw (not shown) to secure the riser cover on a riser section 10 by connection to the hollow bores in ends 42*b* of bosses 42 of a riser section 10.

Top surface 54 of the riser cover 50 includes two hollow wells 56. Wells 56 are tapered, starting from a largest diameter 58 at top surface 54 to a somewhat smaller diameter, where there is a ledge 60, then tapered again, starting from a third diameter 62 to a fourth diameter second depth.

In the preferred embodiment, wells 56 are located approximately 180° apart at a radius approximately half the radius of the entire riser cover 50, but can be located anywhere on the riser cover and there can be more or fewer than two. Each well 56 is constructed such that a metal rod 57 can be placed inside the well prior to the riser cover 50 being buried in place while in use. The metal rod 57 shown in FIG. 5 can be, for example, a length of number four rebar. It serves to provide a mass of metal that can be detected by a metal detector so that the cover and riser stack can be located after it is buried under soil and vegetation.

Figure 8:
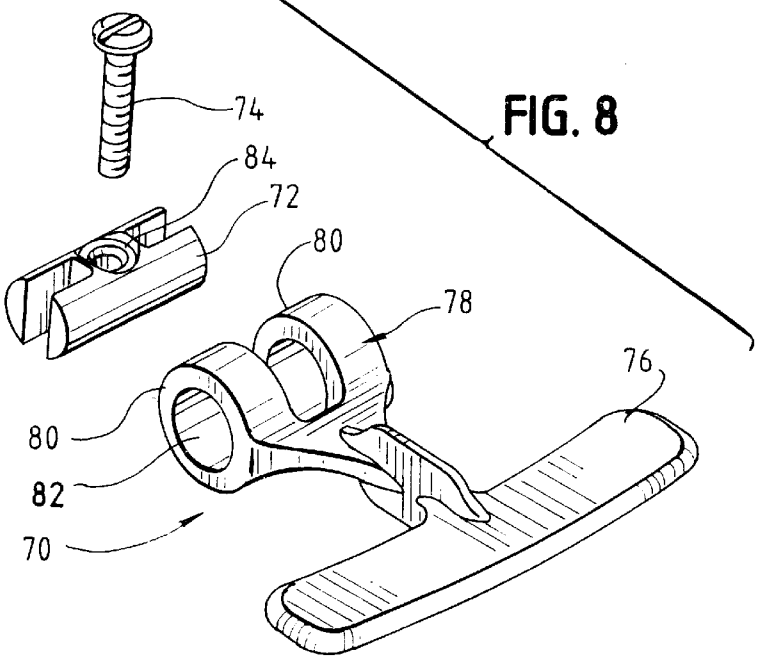
FIG. 8 is a detailed view of a handle adapted to fit the riser cover embodying the principles of the present invention.

Two recessed openings 64, for receiving a pivotably mounted, stowable handle 70, shown in FIG. 8, are arranged such that when handles 70 are pivoted down into recess openings 64, each handle 70 is flush with or recessed from top surface 54 of riser cover 50. Located inside each recess opening 64 is a space 66 adapted to receive a pivot rod, about which handle 70 pivots. A screw receptacle 68 is located inside space 66, which is used to secure the pivot rod 72 to the riser cover 50.

Also on bottom surface 90 are two protrusions 105 corresponding to recessed openings 64, and two cylindrical protrusions 106 corresponding to screw receptacles 68.

Handle 70 includes a grip portion 76 adapted to be easily grasped by a hand, and a pivot portion 78 consisting of two hollow cylindrical portions 80. Pivot rod 72 is inserted into hollow openings 82 of each cylindrical portion 80, spanning cylindrical portion 80, and a screw 74 is placed in screw opening 84 on pivot rod 72 and secured to screw receptacle 68 located inside space 66 of cover 50.

FIG. 6 shows bottom surface 90 of riser cover 50. One difference in cover channel end 27*c* from channel end 27 of riser section 10 is the protrusions 93 contained at various positions on the middle wall 20*c* of the riser cover 50 disposed between adjacent slots 16*c*. Protrusions 93 are used to "child proof" the cover. A screw or other suitable fastener is inserted through webs 34 in outer wall 18 of the top riser section 10 in a riser stack. The fastener pierces aligned protrusion 93 to provide a further connection between cover 50 and the associated top riser section 10. The fastener must be removed to remove the cover from the top riser section.

Referring to FIG. 6, a cylindrical wall 94 is located on bottom surface 90, concentric with channel end 27*c* of riser cover 50. A plurality of vertically disposed support ribs 96, each extending radially out from the cylindrical wall 94 to the inner wall 22*c* of the cover channel end 27*c*, are provided on bottom surface 90. Bottom edges 94*a* and 96*a* of cylindrical wall 94 and support fibs 96 define surfaces for contact with top surface 54 of another cover, when such covers are stacked upon each other. In other embodiments, where the riser cover is of a different shape, the central wall may be cylindrical or may have the same general shape as the walls of the channel end and be set in from the interior wall, with reinforcing ribs extending from the central wall to the interior wall of cover channel end 27*c*, which is concentric with or (in the case of a square- or rectangular-shaped cross-section) parallel to the outer sidewall outer surface.

Also on bottom surface 90 of riser cover 50 are two hollow posts 98. These posts define the wells 56 located on top surface 54 of cover 50. Posts 98 are vertically elongate and extend below channel end 27*c*.

Each post 98 has a first diameter 100 at its base, then tapers to a second diameter 101 at a midpoint where there is a shoulder 102. There, the post transitions to a third diameter 103, and then tapers to a fourth diameter 104 at the end thereof, similar to the shape of wells 56. Each post 98 and well 56 is sized such that the post 98 of a first riser cover 50 will fit inside the well 56 of a second riser cover 50. Thus, the portion of the post 98 between the third and fourth diameters fits within the portion of a well 56 on an associated cover between third diameter 62 and the fourth diameter at the bottom of the well. The portion of the post 98 from its base 100 to second diameter 101 fits within the tapered portion of well 56 between its largest diameter 58 and the smaller diameter at ledge 60. This arrangement allows for easy stacking of a plurality of riser covers both for storage and for shipping.

An actual cover 50 has been constructed which embodies the principles of the present invention. It is approximately twenty-two and one-half inches in diameter at the outer peripheral surface of outer wall 18*c*. Each post 98 is about three inches in length from base 100 at bottom surface 90 of cover 50 to end 104, which is about ¾ inch in diameter. The wells 56 of posts 98 are about ⅞ inch in diameter at top surface 54 of cover 50.

Vertical centerlines passing through each well are 9½ inches apart. The horizontal centerlines of pivot rods 72 are 15 ½ inches apart. The recesses 64 are aligned with the wells 56 of posts 98. Six openings 52*c*are positioned 60° apart on top surface 54. The slots 16*c*, and consequently the projections 42*c*, are 20° apart.

Figure 10:
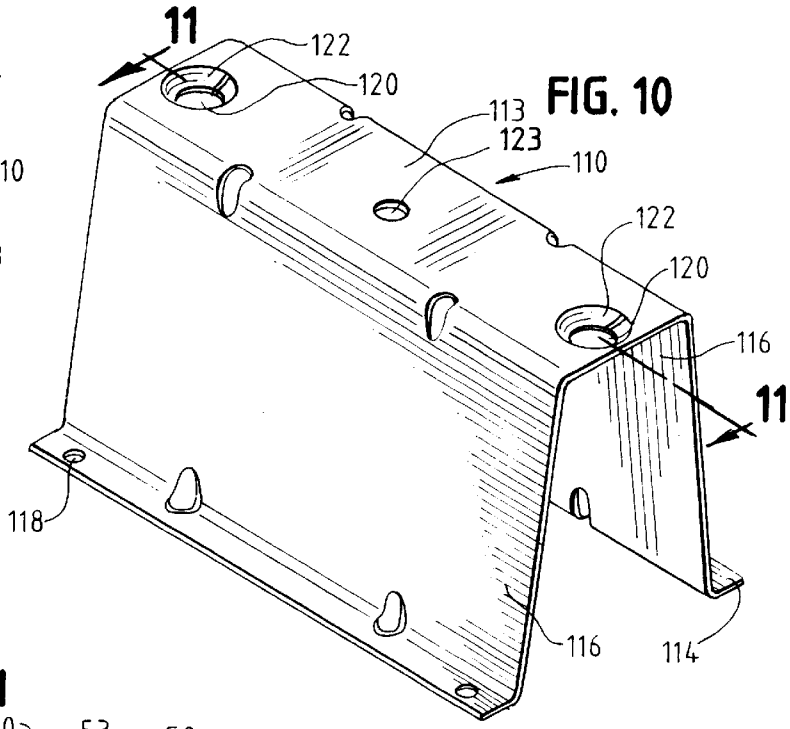
FIG. 10 is a perspective view of the mounting bracket of FIG. 9.
Figure 9:
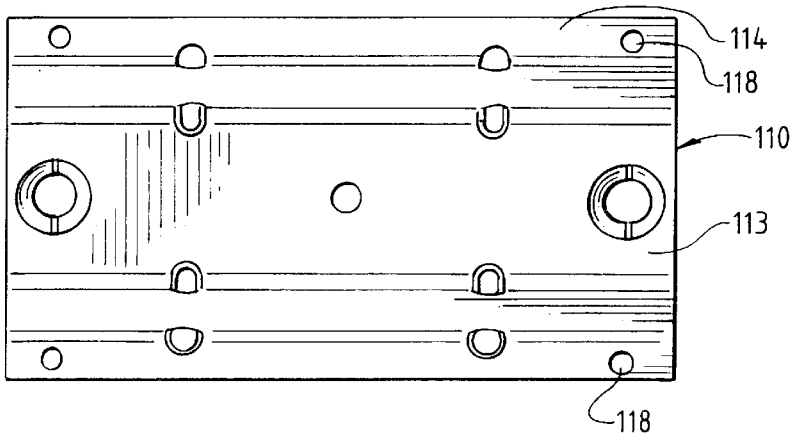
FIG. 9 is a top view of a mounting bracket for use in the method of the present invention employing a riser cover to embed a riser section in concrete.

A mounting bracket 110 (shown in FIGS. 9–11) is provided to secure a riser section in position on a wall of concrete form while the riser section is being molded in concrete. The mounting bracket 110 is generally inverse U-shaped, having a flat top portion 113 and sidewall 116 that diverge from the top portion 113. Flanges 114 project from sidewalls 116. Flanges 114 have holes 118 for securing mounting bracket 110 to the floor of a concrete form. Top portion 113 has at least two apertures 120, which have tapered sides 122 that form gripping webs.

It may also include a hole 123 centrally located in top 113 that may be used for sighting to position the bracket over a mark, for example, placed on the wall of the form. As each post or post 98 is inserted into an aligned aperture 120, tapered sides 122 engage the post at a point between third diameter 103 and fourth diameter 104 of post 98, creating a tight, friction fit between post 98 and tapered sides 122 of aperture 120, as shown in FIG. 11.

Figure 11:
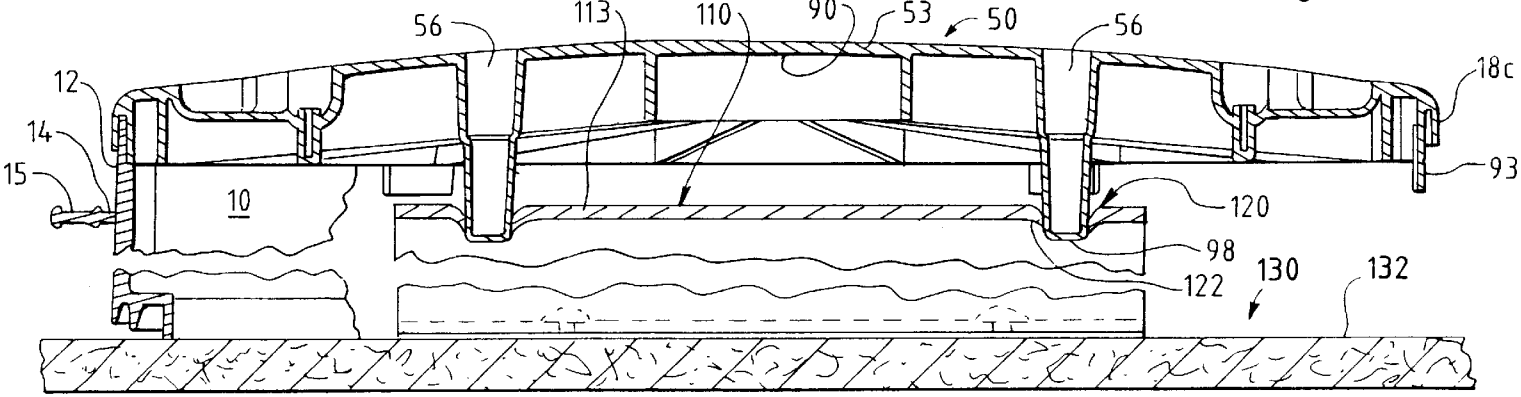
FIG. 11 is a is a cross-sectional view of the riser cover embodying the principles of the present invention mounted onto the mounting bracket employed in the method of the present invention taken along a line 7—7 of FIG. 5 for the cover and a line 11—11 of FIG. 10 for the mounting bracket.

As illustrated in FIG. 11, mounting bracket 110 is secured on form wall or floor 132 of form 130 by screws or other fasteners inserted in bore holes 118. A riser section 10 with anchor tab 14 attached is then placed into form 130, around mounting bracket 110, with channel end 27 of riser section 10 substantially in contact with floor 132 of form 130. Riser cover 50 is then placed on riser section 10 and positioned with channel end 27*c* in place on tapered end 37 of the riser section 10. The cover 50 may be secured to the riser section by screws in openings 52*c*. The cover is secured in position as posts 98 are inserted into corresponding apertures 120 of mounting bracket 110 and frictionally grasped by tapered sides 122.

Alternatively, riser cover 50 can be placed and secured on riser section 10 before riser section 10 is placed into form 130. Then, the riser section 10 and riser cover 50 assembly are placed into form 130. Posts 98 are inserted into apertures 120 on mounting bracket 110.

After the riser section 10 is positioned and secured on form wall 132, concrete is poured into the form 130, preferably to a level above the detachable anchor tab 14 and below riser cover 50. Once the concrete is cured, riser cover 50 is removed from riser section 10 and mounting bracket 110 by pulling the posts from their frictional engagement with apertures 120.

Riser section 10, thus anchored in concrete, may then be used as the bottom-most riser section in a stack of riser sections 10 to define an access to an underground component such as a concrete distribution box. Cover 50 is secured to the top riser section to close and seal the access. The cover 50 is removed when access to the underground component is required.

Whereas the present invention is described herein with respect to specific embodiments thereof, it will be understood that various changes and modifications may be made by one skilled in the art without departing from the scope of the invention, and it is intended that the invention encompass such changes and modifications as fall within the scope of the appended claims.

What is claimed:

1. A cover for an access riser section having a sidewall with an upper end and a plurality of vertical bosses and vertical ribs extending along the inner surface of the sidewall, said cover comprising;

a wall defining a top and a bottom surface, a channel end depending from said wall and extending below the bottom surface of said cover which includes depending walls, defining between them, a channel adapted to receive the upper end of a riser section and a second channel adapted to receive the bosses and ribs of a riser section wherein projections are spaced about said second channel positioned to align with the bosses of a riser section.

2. A cover for an access riser section as claimed in claim 1 wherein said first channel is shaped to receive a tapered upper end of a riser section.

3. A cover for an access riser section having a sidewall with an upper end and a plurality of vertical bosses and vertical ribs extending along the inner surface of the sidewall, said cover comprising:

a wall defining a top surface and a bottom surface, a channel end depending from said wall which includes walls defining a channel adapted to receive the upper end of a riser section, and a second channel adapted to receive the bosses and ribs of a riser section, wherein projections are spaced about said second channel positioned to align with the bosses of a riser section.

4. A cover for an access riser section as claimed in claim 3 wherein said second channel includes projections, positioned to align with each boss and rib of a riser section; and is defined by a wall having slots spaced about said walls, and said slots are sized to permit said channel end to receive the bosses and ribs of a riser section.

5. A cover for an access riser section as claimed in claim 4 wherein said slots in said wall are aligned with said projections in said second channel.

6. A cover for an access riser section as claimed in claim 4 wherein said channel end is generally cylindrical and said slots are sized to prevent rotation of said cover relative to a riser section.

7. A cover for an access riser section as claimed in claim 5 wherein said channel end is generally cylindrical and said slots are sized to prevent rotation of said cover relative to a riser section.

8. A cover for an access riser section as claimed in claim 6 wherein said first channel is shaped to receive a tapered upper end of a riser section.

9. A cover for an access riser section as claimed in claim 7 wherein first channel is shaped to receive a tapered upper end of a riser section.

10. A cover for an access riser section, as claimed in claim 3, said wall defining at least one recess opening, said cover further comprising a stowable handle connected to said cover within said recess, said handle being pivotable between positions extending from said recess to a position completely within said recess.

11. A cover for an access riser section as claimed in claim 10 wherein said cover end portion is generally cylindrical and wherein said cover wall defines two recess openings approximately 180° apart, and wherein a pivotal handle is received in each said recess opening.

12. A cover for an access riser section as claimed in claim 3, wherein, said wall defines at least one post extending from said bottom surface and below said end portion, and said post being tapered, and defining a well open at said top surface sized to receive the post of another cover.

13. A cover for an access riser as claimed in claim 12 wherein said bottom surface includes two posts disposed approximately 180° apart.

14. A cover for an access riser as claimed in claim 12 wherein said at least one well is sized to receive a length of metal rod therein.

15. A cover for an access riser as claimed in claim 13 wherein said wells are each sized to receive a length of metal rod therein.

16. A cover for an access riser as claimed in claim 12 wherein said wall defines at least one recess, a stowable handle is connected to said cover within said recess, said handle being pivoted between positions extending from said recess to a position completely within said recess.

17. A cover for an access riser section as claimed in claim 13 wherein said cover end portion is generally cylindrical and wherein said cover wall defines two recesses approximately 180° apart, and wherein a pivotal handle is received in each said recess.

18. A cover for an access riser as claimed in claim 17 wherein said recesses and posts are aligned with each other.

19. A cover for an access riser section as claimed in claim 9 wherein:

at least one protrusion depends from said channel end and is adapted to receive a fastener extending through a sidewall of a riser section.

20. A cover for an access riser section having a sidewall with an upper end and a plurality of vertical bosses and vertical ribs extending along the inner surface of the sidewall, said cover comprising:

a wall defining a top surface and a bottom surface, a channel end depending from said wall which includes walls defining a channel adapted to receive the upper end of a riser section, and a second channel adapted to receive the bosses and ribs of a riser section, wherein said second channel is defined by a wall having slots spaced about said wall, and said slots have a length that is less than the length of said wall between said slots and said slots are sized to permit said channel end to receive the bosses and ribs of a riser section.

21. A cover for an access riser section as claimed in claim 20 wherein said second channel includes projections positioned to align with each boss and rib of a riser section.

22. A cover for an access riser section as claimed in claim 21 wherein said slots in said wall are aligned with said projections in said second channel.

23. A cover for an access riser section as claimed in claim 20 wherein said channel end is generally cylindrical and said slots are sized to prevent rotation of said cover relative to a riser section.

24. A cover for an access riser section as claimed in claim 21 wherein said channel end is generally cylindrical and said slots are sized to prevent rotation of said cover relative to a riser section.

25. A cover for an access riser section as claimed in claim 22 wherein said channel end is generally cylindrical and said slots are sized to prevent rotation of said cover relative to a riser section.

26. A cover for an access riser section as claimed in claim 20 wherein said first channel is shaped to receive a tapered upper end of a riser section.

27. A cover for an access riser section as claimed in claim 21 wherein said first channel is shaped to receive a tapered upper end of a riser section.

28. A cover for an access riser section as claimed in claim 22 wherein said first channel is shaped to receive a tapered upper end of a riser section.

29. A cover for an access riser section as claimed in claim 21 wherein:

at least one protrusion depends from said channel end and is adapted to receive a fastener extending through a sidewall of a riser section.

30. A cover for an access riser section as claimed in claim 21 wherein:

at least one protrusion depends from said channel end and is adapted to receive a fastener extending through a sidewall of a riser section.

31. A cover for an access riser section as claimed in claim 24 wherein:

at least one protrusion depends from said channel end and is adapted to receive a fastener extending through a sidewall of a riser section.

32. A cover and access riser section combination, said riser section having a single sidewall with an upper end and an inner and outer surface, and and at least a plurality of vertical bosses extending along the inner surface of said sidewall, said cover comprising:

a wall defining a top surface and a bottom surface, a channel end depending from said wall which includes walls defining at least one channel for receiving said bosses of said riser section, said bosses of said riser section disposed in said boss receiving channel of said channel end.

33. A cover and access riser section combination as claimed in claim 32 wherein projections are spaced about said boss receiving channel aligned with said bosses of said riser section and said bosses abut said projections.

34. A cover and access riser section combination as claimed in claim 32 wherein said channel is defined by a wall having slots spaced about said wall, and said slots permit said channel end to receive said bosses of said riser section, offsetting portions supporting said bosses on said inner surface of said sidewall, said offsetting portions of each said boss disposed in one of said slots.

35. A cover and access riser section combination as claimed in claim 33 wherein said channel is defined by a wall having slots spaced about said wall, and said slots permit said channel end to receive said bosses of said riser section, offsetting portions supporting said bosses on said inner surface of said sidewall, said offsetting portions of each said boss disposed in one of said slots.

36. A cover and access riser section combination as claimed in claim 32 wherein said inner surface of said sidewall includes at least one vertical rib positioned intermediate adjacent bosses and said boss receiving channel includes projections, aligned with each boss and each rib of said riser section, said bosses and ribs abutting said projections.

37. A cover and access riser section combination as claimed in claim 33 wherein said inner surface of said sidewall includes at least one vertical rib positioned intermediate adjacent bosses and said boss receiving channel includes projections, aligned with each boss and each rib of said riser section, said bosses and ribs abutting said projections.

38. A cover and access riser section combination as claimed in claim 34 wherein said inner surface of said sidewall includes at least one vertical rib positioned intermediate adjacent bosses and said boss receiving channel includes projections, aligned with each boss and each rib of said riser section, said bosses and ribs abutting said projections.

39. A cover and access riser section combination as claimed in claim 35 wherein said inner surface of said sidewall includes at least one vertical rib positioned intermediate adjacent bosses and said boss receiving channel includes projections, aligned with each boss and each rib of said riser section, said bosses and ribs abutting said projections.

40. A cover and access riser section combination as claimed in claim 32 wherein said walls of said channel end define an end receiving channel to receive an upper end of a riser section, and said upper end of said riser section is disposed in said end receiving channel.

41. A cover and access riser section combination as claimed in claim 33 wherein said walls of said channel end define an end receiving channel to receive an upper end of a riser section, and said upper end of said riser section is disposed in said end receiving channel.

42. A cover and access riser section combination as claimed in claim 34 wherein said walls of said channel end define an end receiving channel to receive an upper end of a riser section, and said upper end of said riser section is disposed in said end receiving channel.

43. A cover and access riser section combination as claimed in claim 35 wherein said walls of said channel end define and end receiving channel to receive said upper end of a riser section, and said upper end of said riser section is disposed in said other channel.

44. A cover and access riser section as claimed in claim 34 wherein said slots in said wall are aligned with said projections.

45. A cover and access riser section as claimed in claim 35 wherein said slots in said wall are aligned with said projections.

46. A cover and access riser section as claimed in claim 38 wherein said slots in said wall are aligned with said projections.

47. A cover and access riser as claimed in claim 34 wherein said riser section and said cover are generally cylindrical and said slots are sized to prevent rotation of said cover relative to a riser section.

48. A cover and access riser section as claimed in claim 35 wherein said riser section and said cover is generally cylindrical and said slots are sized to prevent rotation of said cover relative to a riser section.

49. A cover and access riser section as claimed in claim 38 wherein said channel end is generally cylindrical and said slots are sized to prevent rotation of said cover relative to a riser section.

50. A cover and access riser section as claimed in claim 40 wherein said upper end of said sidewall is tapered and wherein said end receiving channel is shaped to receive a tapered end of said riser section.

51. A cover and access riser section as claimed in claim 41 wherein said upper end of said sidewall is tapered and wherein said end receiving channel is shaped to receive a tapered end of said riser section.

52. A cover and access riser section as claimed in claim 42 wherein said upper end of said sidewall is tapered and wherein said end receiving channel is shaped to receive a tapered end of said riser section.

53. A cover and access riser section as claimed in claim 43 wherein said upper end of said sidewall is tapered and wherein said end receiving channel is shaped to receive a tapered end of said riser section.

* * * * *